US006619643B1

(12) United States Patent
Hayday

(10) Patent No.: US 6,619,643 B1
(45) Date of Patent: Sep. 16, 2003

(54) CLAMPING DEVICE

(76) Inventor: George Hayday, 84 High Rd., Wortwell, Harleston, Norfolk (GB), IP20 0EN ( * ) Notice: Subject to any disclaimer, the term of this patent is extended or adjusted under 35 U.S.C. 154(b) by 0 days.

(21) Appl. No.: 09/980,673

(22) PCT Filed: Apr. 20, 2000

(86) PCT No.: PCT/GB00/01575

§ 371 (c)(1),
(2), (4) Date: Feb. 28, 2002

(87) PCT Pub. No.: WO00/64643

PCT Pub. Date: Nov. 2, 2000

(30) Foreign Application Priority Data

Apr. 21, 1999 (GB) ..... 9909031
Apr. 23, 1999 (GB) ..... 9909342

(51) Int. Cl.[7] ..... B25B 1/02

(52) U.S. Cl. ..... 269/139; 269/900; 269/153; 269/155

(58) Field of Search ..... 261/139, 900, 261/901, 283, 104, 116, 111, 219, 303, 305, 152–155

(56) References Cited

U.S. PATENT DOCUMENTS 162,281 A * 4/1875 Fisher ..... 269/139
4,858,902 A * 8/1989 Hickman ..... 269/88
6,416,046 B1 * 7/2002 Hayday ..... 269/139

FOREIGN PATENT DOCUMENTS

DE 2734343 * 2/1977 ..... 269/139
FR 2561154 * 9/1985 ..... 269/139

* cited by examiner

*Primary Examiner*—George Nguyen
*Assistant Examiner*—Daniel Shanley
(74) *Attorney, Agent, or Firm*—Barnes & Thornburg

(57) ABSTRACT

A mechanism is described for incorporating into a clamping workbench of the type comprising a pair of main clamping jaws (234, 237) and a supplementary clamping jaw (230) which is movable as a consequence of relative movement of the main jaws to engage and clamp a workpiece lying across the main jaws. The clamping movement of the supplementary jaw (230) is generally perpendicular to that of the main jaws. The invention concerns a supplementary jaw (230) having a single actuating arm (238), one end of which is adapted to be pivotally received in an opening (246) in one of the main jaws (237), and the other end of which is slidably connected to the supplementary jaw (230) and held captive therein by pin means (304, 306) extending above and below the captive end of the arm (238). Typically the pins (304, 306) engage in two aligned slots (300, 302) in the supplementary jaw (230) and the inboard end of the actuating arm is pivotally securable in one of at least two spaced apart points along the length of the two aligned slots (236, 242) to permit the supplement clamping jaw (230) to be adjusted in position to accommodate different workpiece widths. The aligned slots (236, 242) can extend generally parallel or perpendicular to the workpiece engaging face of the supplementary clamping jaw (230).

13 Claims, 2 Drawing Sheets

CLAMPING DEVICE

This invention relates to clamping workbenches such as those of the type sold under the Trade Mark WORKMATE, and in particular to a secondary clamp for attachment thereto.

BACKGROUND TO THE INVENTION

FIG. 19 of our UK Patent Application No. 9824243.1 illustrates one embodiment of a secondary clamp for attachment to a Workmate type clamping workbench which comprises a supplementary clamping jaw adapted to rest perpendicularly across the main jaws of a clamping workbench, with a single actuating arm, one end of which is adapted to be received in an opening in one of the jaws of the main clamping workbench and the other end of which is held captive in the supplementary jaw, and is pivotal relative thereto. In fact the joint between the end of the arm and the supplementary clamping jaw is a complex one and the arm not only pivots relative to the supplementary clamping jaw but is also slidable along upper and lower aligned slots in the supplementary clamping jaw, the direction of the slots being parallel to the length direction of the supplementary jaw and therefore being substantially perpendicular to the main jaws of the clamping workbench when the supplementary clamping jaw is fitted thereto.

Each of the main clamping workbench jaws is conventionally formed with a plurality of equally sized and equally spaced apart circular openings into which peg stops can be fitted to assist in clamping differently sized objects over the top of the jaws, as opposed to between the jaws. However from a study of FIG. 19 of our aforementioned Application it will be seen that there will be only a certain number of positions along the length of the main jaws of the clamping workbench at which the end of the pivoting arm can be inserted into an opening in one or the other of the main clamping workbench jaws, and if reliance is placed on jamming the other end of the arm at one end of the slots slot to achieve perpendicular movement of the supplementary clamping jaw relative to the closing or opening movement of the main jaws in accordance with the technique described in our earlier Application No. 9824243.1, there could be a number of "blind spots" along the length of the main jaws at which it is not possible to obtain a reliable clamping movement of the supplementary jaw against a workpiece, or the two main jaws have to be moved undesirably close or far apart in order to achieve a clamping of the supplementary jaw relative to a workpiece.

For reference purposes, the positions along the length of the main jaws at which the supplementary jaw can be fitted across the main jaws with one end of the lever arm jammed at one end of the slots, and with the main jaws opened sufficiently to provide reliable support to the underside of a workpiece, will be referred to as primary clamping positions, and the position to which the supplementary jaw can be moved by a relatively small inward or outward movement of the main jaws so as to secure a clamping action on the workpiece, without significantly increasing or decreasing the gap between the two main jaws to an unacceptable amount, will be referred to as a secondary clamping position.

It is an object of the present invention to increase the number of primary and therefore secondary clamping positions in which a supplementary clamping jaw can be fitted between the main jaws of a clamping workbench, to increase the range of workpieces sizes which can be accommodated by such a supplementary clamping jaw.

SUMMARY OF THE INVENTION

According to one aspect of the invention in a clamping workbench as aforesaid, the inboard end of the actuating arm is pivotally securable in one of at least two spaced apart positions located along the length of the two aligned slots, and intermediate the ends thereof.

The invention envisages that the aligned slots extend either generally parallel or generally perpendicular to the workpiece engaging face of the supplementary jaw.

In a first embodiment of the invention, pairs of parking bays are provided at intervals along the length of the pair of aligned slots, for receiving therein the pin means at the inboard end of the actuating arm, each pair of parking bays defining a different pivoting position for the said inboard end of the arm.

Each pair of parking bays may comprise a pair of aligned lateral parking slots, one in the wall of each of the two aligned slots, each of which said lateral parking slots communicates with its aligned slot via an opening in the wall thereof, and subtends an angle of greater than 90° to the length direction of the said aligned slot.

Each parking bay may include a second lateral parking slot, which diverges from the slot making up the first bay, but communicates with the aligned slot via a common opening, the two parking slots defining a letter V, with the vertex thereof comprising the common opening in the wall of the aligned slot, and with the V-shaped array of slots at each position along one aligned slot being aligned with a corresponding V-shaped array at the same position along the other aligned slot.

By providing the parking slots in the edge of a main aligned slots against which the pins protruding from the arm will press as the main clamping jaws are moved in a direction so as to clamp the supplementary jaw against a workpiece, whereby the act of clamping will push the pins into whichever pair of parking slots has been selected and there will be no tendency for the protruding pins to slide further along the length of the aligned slots in the supplementary jaw.

A plurality of such pairs of upper and lower aligned parking slots may be provided at intervals along the length of the main slots.

The angles selected for the parking slots relative to the aligned slots define the direction of movement needed of the protruding pins to enter the parking slots, and preferably this is selected so as to be approximately in the same direction as the direction of the thrust transmitted from the end of the arm anchored to one of the main clamping workbench jaws, along the length of the arm.

In a second embodiment, stop means may be provided for arresting the relative sliding of the pivoting connection between the arm and the supplementary jaw in a clamping workbench as aforesaid, so as to provide a range of positions along the length of the aligned slots in the supplementary jaw at which the end of the pivoting arm can be fixed.

The intermediate stop positions may be achieved by providing a plurality of drillings in the body of the supplementary jaw, each of the drillings extending across the slots above and below the cavity in which the inboard end of the arm is received, and by inserting pins into the drillings, so as to foreshorten the slots, so the extent of the travel along the length of the slots, by the pins, will be reduced.

If desired, two pairs of pins can be inserted so as to define a relatively short slot length within which the pins protruding from the arm can move.

In a third embodiment, elongate inserts can be provided for fitting into the aligned slots of the supplementary jaw again to restrict the length of the slots available to the pins protruding from the arm.

In this way it is not necessary for the inboard end of the pivoting arm always to travel to one end or the other of the aligned slots, but can if desired be located at intermediate positions between the ends of the slots so as to allow the user to jam the arm relative to the supplementary jaw at a plurality of different positions along the length of the slots to thereby increase the range of primary clamping positions for the supplementary jaw (and as a consequence its range of secondary positions) which can be achieved by a clamping or unclamping movement of the main clamping workbench jaws, whilst leaving the outboard end of the arm pivotally inserted in one opening in one of the main jaws of the clamping workbench.

According to another aspect of the invention, a peg which protrudes from the outboard end of the arm of a single arm supplementary clamping jaw as aforesaid, may be selectably insertable into one or other of two or more spaced apart openings along the length of the arm, to further increase the number of different positions at which clamping can be effected.

The invention also lies in a combination of the different aspects of the invention to provide an even greater range of variation in the primary clamping positions for the supplementary jaw, and therefore a corresponding increase in the number of secondary positions achievable by the jaw relative to any given pair of main clamping workbench jaws.

An important aspect of the invention lies in the fact that a large number of primary and secondary clamping positions for the supplementary jaw are still possible, particularly when both aspects of the invention are incorporated, even with a reduced number of peg stop openings in the main workbench jaws.

The invention will now be described, by way of example with reference to the accompanying drawings, in which.

Figure 1:
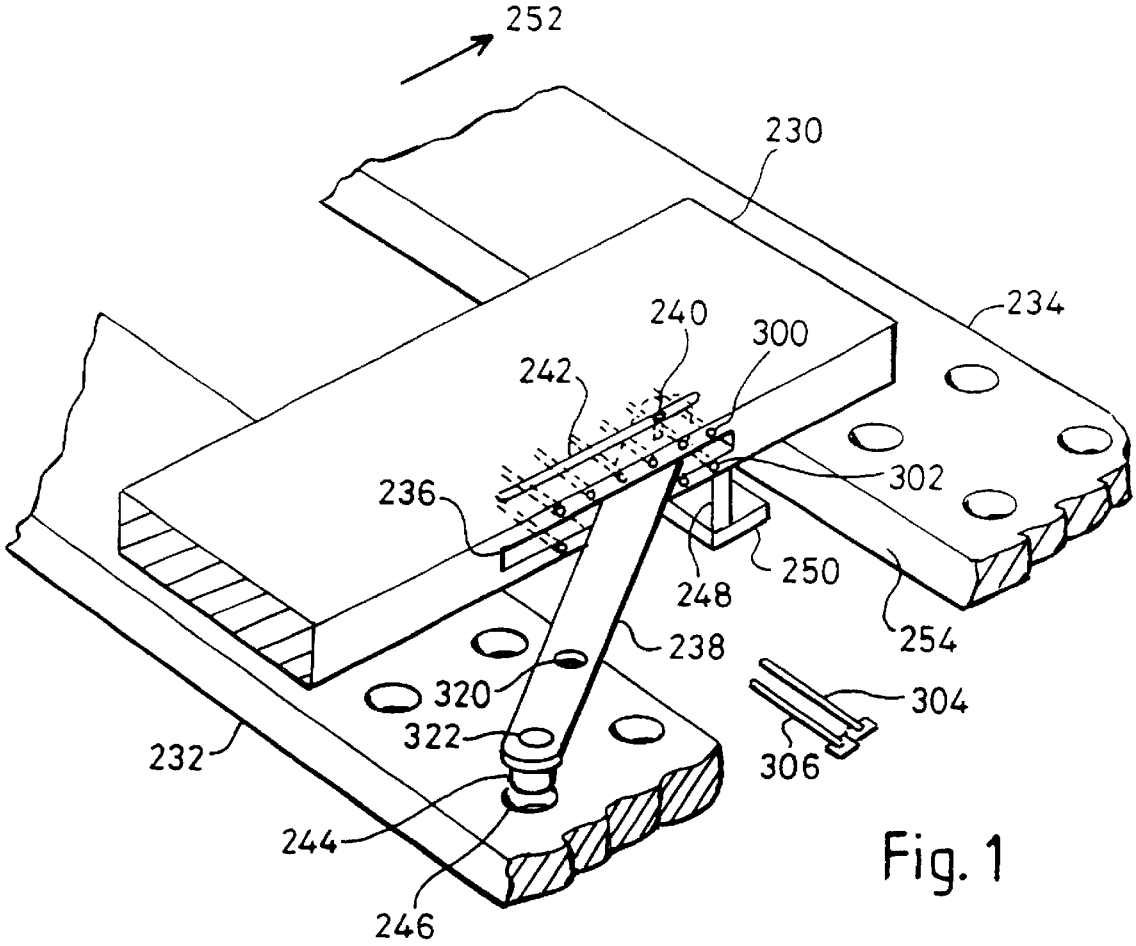
FIG. 1 is a perspective view similar to that of FIG. 19 of our copending Application No. 9824243.1 and in which similar reference numerals are used as were used in the description accompanying the aforementioned Application to identify the parts in common.

In FIG. 1, the supplementary jaw 230 is modified by the inclusion of a plurality of pairs of parallel drillings, one pair of which is shown at 300 and 302 respectively into which pairs of pins 304 and 306 can be inserted so as to intersect and cross the two slots one of which is shown at 242 in the upper and lower walls of the cut-away region of the supplementary jaw 230 and which receive the pins one of which is shown at 240 which run in the slot and retain the arm 238 attached to the supplementary jaw 230.

By inserting another pair of pins (not shown) so the travel of the protruding pins such as 240 along the slots such as 242 can be restricted to literally the space between two adjoining pairs of drillings or alternatively by spacing the two pairs of pins further apart, to the distance between the pairs of drillings into which the pins have actually been inserted.

Figure 2:
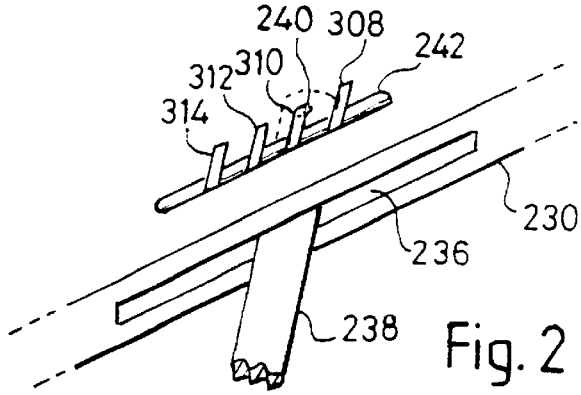
FIG. 2 is a perspective view of a modification of the slot arrangement incorporated in the supplementary jaw of FIG. 1.

FIG. 2 shows a preferred alternative in which each of the slots, one of which is shown at 242, is formed with a plurality of side slots or parking slots 308, 310, 312 and 314 respectively with similar parallel parking slots being provided from the parallel slot in the underside of the jaw 230 but not visible in FIG. 2.

By aligning the pins of which one is shown at 240 with the entrance to one of the parking slots such as that shown at 310, so the arm 238 can be pushed further into the supplementary clamping jaw 230 than would have been permitted by the primary slot 242, but once the pins such as 240 engage in the ends of the two parking slots, the arm 238 will be able to move no further and whilst still being able to pivot relative to the supplementary clamping jaw 230, will not be capable of sliding further along the length direction of the clamping jaw 230.

By selecting an appropriate pair of parking slots, so the arm can be made to pivot at just the desired position along the length of the primary slot 242 to give a desired primary clamping position for the supplementary clamping jaw 230.

Figure 3:
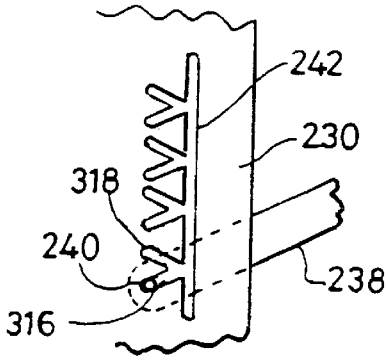
FIG. 3 is a further variation on the parking slot arrangement of FIG. 2.

FIG. 3 shows a further and preferred alternative arrangement in which each parking position is defined by two slots in the form of a letter V and one or the other of the parking slot is selected depending on the angle which the arm 238 makes to the supplementary jaw 230. Thus as shown in FIG. 3, pin 240 is shown engaged at the far end of the left hand limb 316 of a two-limbed parking slot 316, 318. If the arm 238 were angled in a complementary manner for engaging the opposite main clamping jaw, then the alternative limb 318 would be used to receive the pin 240.

Similar V-shaped parking slots are provided in the aligned slot in the underside of the supplementary jaw 230 to receive the downwardly protruding pins (not shown) from the arm 238.

In accordance with the second aspect of the invention, the peg 244 is securable in each of two (or more) openings 320 and 322 in the arm 238. As shown the peg 244 is secured in the furthermost opening 322.

Typically the peg is formed with a screw thread and the openings 320 and 322 are formed with a complementary thread profile so that the peg can be threadedly engaged and screwed into one or the other of the holes as desired. Alternatively, a snap coupling or quick release coupling may be employed.

By removing the peg 244 from the opening 322 and inserting and securing the peg 244 into the other opening 320, so a different opening in the main jaw 232 can be used for housing the peg 244 thereby increasing the number of primary clamping positions for the supplementary jaw 230.

It is to be understood that although the multiple opening arm 238 is only shown in combination with the drillings 300, 302, the invention is not limited to that particular combination and the multiple openings such as 320 and 322 and adjustable position for the peg 244 may be combined with the supplementary parking slots such as 308, 310 etc. or V-shaped parking slots such as 316, 318 as shown in FIGS. 2 and 3.

Figure 4:
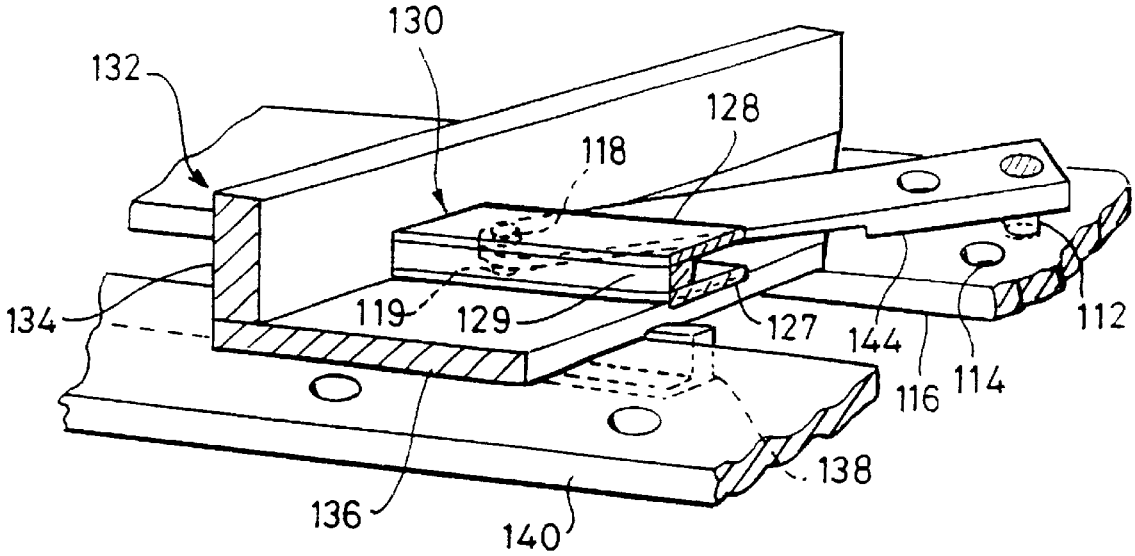
FIG. 4 shows a modified clamp constructed in accordance with the invention.
Figure 5:
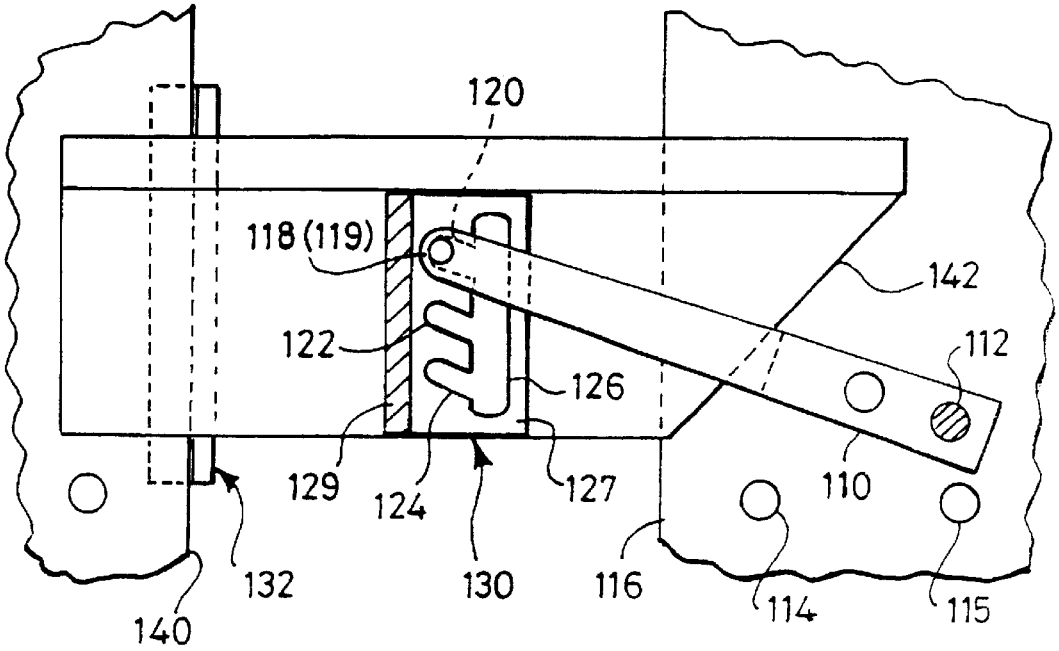
FIG. 5 is a plan view of the device shown in FIG. 3 with part removed to reveal the guide means and parking positions for the inboard end of the actuating lever.

In FIGS. 4 and 5, the lever 110 has a peg 112 at its outboard end for engaging a hole such as 114 or 115 in one of the main clamping jaws 116 of the clamping workbench. At its other end it has upper and lower pins 118 and 119.

The lower pin 119 can be engaged in one of three parking slots 120, 122, 124 which communicate with a main slot 126 in the lower plate 127 of a three part retention bracket made up of the lower plate 127, an upper plate 128 and a spacer 129.

The underside of the upper plate 128 (removed in FIG. 5) is formed with an arrangement of slots 120', 122', 124', 126' (not shown) similar to the slots 120, 122, 124 and 126, which align with the latter when the plates are fitted to the spacer as shown in FIG. 4. The pin 118 engages the slots 120', 122' etc. in the underside of the upper plate 128.

The inboard end of the lever 110 is therefore held captive between the upper and lower plates 127, 128, is slidable along the length of the longer aligned slots (126, 126'), and can be parked in any one of the pairs of aligned side slots (120, 120'), (122, 122') or (124, 124'), by appropriate movement of the lever relative to the bracket, generally designated by 130.

The supplementary clamping jaw 132 is made up of a vertical thrust-plate 124 and horizontal base plate 136, to which the bracket is attached. By virtue of the engagement of the inboard end of the lever 110 with the bracket 130, thrust is transmitted by the lever 110 to the jaw 132.

In the same manner as described in our earlier Applications, a retainer 138 is fitted to the underside of the base plate 136, to engage below the inboard edge of the main jaw 140, which comprises the other of the two parallel main clamping jaws of the clamping workbench.

The retainer 132 prevents the supplementary clamping jaws 134 from lifting off the main clamping workbench jaws 116, 140.

The right hand end of the lower plate 136 is cut away at 142 to allow the thicker outboard end 144 of the lever 110 to swing into position (such as shown in FIG. 5), which it could otherwise be prevented from occupying, by virtue of the interference of the thick region 144 with the end of the plate 136.

What is claimed is:

1. A clamping workbench comprising a pair of main clamping jaws and a supplementary clamping jaw having a workpiece engaging face and a single actuating arm having an outboard end which is adapted to be pivotally received in an opening in one of the main jaws, and an inboard end which is slidably connected to the supplementary jaw and held captive therein by pin means which extend above and below the arm to engage in two aligned slots in the supplementary jaw being pivotable relative to the arm at opposite ends of the two aligned slots and means is provided which defines an intermediate position between the ends of the two slots in which the inboard end of the actuating arm is also pivotable relative to the arm.

2. A clamping workbench as claimed in claim 1, wherein the aligned slots extend generally parallel to the workpiece engaging face of the supplementary clamping jaw.

3. A clamping workbench as claimed in claim 1, wherein the aligned slots extend generally perpendicular to the workpiece engaging face of the supplementary clamping jaw.

4. A clamping workbench as claimed in claim 1, wherein the intermediate position is defined by stop means insertable so as to shorten the length of the slots along which the pins can travel.

5. A clamping workbench as claimed in claim 4, wherein drillings are provided in the supplementary jaw body, which intersect the slots, and pin means is provided for insertion into one or more of the drillings, to extend across the slots to define the said intermediate position.

6. A clamping workbench as claimed in claim 4, wherein a first elongate insert is provided which is insertable into one of the slots to define the said intermediate position.

7. A clamping workbench as claimed in claim 1, wherein pairs of parking bays are provided at intervals along the length of the pair of aligned slots, for receiving therein the pin means at the inboard end of the actuating arm, each pair of parking bays defining a different pivoting position for the inboard end of the actuating arm.

8. A clamping workbench as claimed in claim 7, wherein the parking bays comprise lateral slots which communicate with openings in the wall of the aligned slots, the lateral slots subtending an angle of greater than 90° to the length of direction of the aligned slots.

9. A clamping workbench as claimed in claim 8, wherein each lateral slot communicates with another differently angled lateral slot in a common opening in the wall of one of the aligned slots, to form an arrangement of slots in the form of a letter V at each parking bay, and for each lateral slot forming one limb of a V there is a similarly angled lateral slot aligned therewith communicating with an opening in the wall of the other aligned slot, whereby pin means at the inboard end of the actuating arm can be pushed into one or the other of the pairs of lateral slots defining one or the other of the limbs of the two aligned V-shaped arrangements of slots at each pair of parking bays.

10. A clamping workbench as claimed in claim 1, wherein a peg which protrudes from the outboard end of the actuating arm for insertion into an opening in a main jaw, is selectably insertable into one of at least two spaced apart openings in the said arm.

11. A clamping workbench as claimed in claim 4 wherein a second elongate insert is provided which is also insertable to further shorten the length of the slots along which the pins can travel.

12. A clamping workbench as claimed in claim 11 wherein the two stop means define a single intermediate position between opposing ends thereof.

13. A clamping workbench as claimed in claim 11 wherein the two stop means define two intermediate positions.

* * * * *